US005561507A

United States Patent [19]

Shelffo et al.

[11] Patent Number: 5,561,507

[45] Date of Patent: Oct. 1, 1996

[54] APPARATUS AND METHOD FOR PRODUCING AN ELECTROSTATIC IMAGE USING WATER-BASE TONER

[75] Inventors: Loren Shelffo, Maplewood, N.J.; Kensuke Fukae, Boulder, Colo.

[73] Assignees: Page Station Technology, Inc., Boulder, Colo.; Technogenesis, Inc., Summit, N.J.

[21] Appl. No.: 272,210

[22] Filed: Jul. 8, 1994

[51] Int. Cl.[6] ..... G03G 15/10

[52] U.S. Cl. ..... 355/256; 430/67

[58] Field of Search ..... 355/211, 256; 430/66, 67, 56; 118/659

[56] References Cited

U.S. PATENT DOCUMENTS

| | | | |
|---|---|---|---|
| 2,886,434 | 5/1959 | Owens | 430/67 |
| 3,486,922 | 12/1969 | Cassiers et al. | 430/106 |
| 4,018,953 | 4/1977 | Martellock | 427/430.1 |
| 4,062,681 | 12/1977 | Lewis et al. | 430/67 |
| 4,139,653 | 2/1979 | Cassiers et al. | 430/97 |
| 4,202,913 | 5/1980 | Klavan et al. | 430/118 |
| 4,245,023 | 1/1981 | Cassiers et al. | 430/118 |
| 4,268,597 | 5/1981 | Klavan et al. | 430/102 |
| 4,272,599 | 6/1981 | Moradzadeh | 430/100 |
| 5,153,659 | 10/1992 | Maiefski et al. | 355/256 |
| 5,289,238 | 2/1994 | Lior et al. | 355/256 |

*Primary Examiner*—Nestor R. Ramirez
*Attorney, Agent, or Firm*—Meltzer, Lippe, Goldstein, et al.

[57] ABSTRACT

An apparatus and method for producing an electrostatic image is disclosed. A thin layer of hydrophobic particles is coated on the surface of the charge bearing member which can be a photoconductor or a dielectric. The hydrophobic particles may also be used on the developer roller which applies the toner. A liquid toner made substantially of a hydrophilic liquid, such as water, and suspended pigment binders is used. The invention is applicable to both one and multiple color systems.

19 Claims, 3 Drawing Sheets

APPARATUS AND METHOD FOR PRODUCING AN ELECTROSTATIC IMAGE USING WATER-BASE TONER

FIELD OF THE INVENTION

The present invention is related to the production of an electrostatic, latent image or pattern on substrates, such as paper. More specifically, this invention is directed to the simplification of the developing, transfer and fixing steps of such production.

RELATED APPLICATION

A patent application entitled, "Apparatus For Forming A Latent Electrostatic Image On A Dielectric Substrate", bearing Ser. No. 08/272,211 is commonly assigned as the present application and was filed concurrently herewith. This application contains subject matter related to the subject matter of the present invention and is hereby incorporated by reference.

BACKGROUND OF THE INVENTION

Known methods of developing electrostatic, latent images fall into one of two categories:

1) Liquid Development in which toner is deposited from a suspension of toner particles in an insulating liquid. This liquid is normally a volatile organic compound which wets the surface of a charge bearing member, thereby producing a film of the organic compound. A portion of the film is transferred together with the toner image to the paper or substrate and then it normally evaporates into the atmosphere.

2) Dry Development in which toner is applied in a powder form. The toner is normally fixed to the paper or substrate by heating the toner or substrate. The range of particle size for the toner is such that airborne particles of the toner create an environmental hazard.

Other prior systems include U.S. Pat. No. 3,486,922 to Cassier et al. which discloses a water based toner with a continuous hydrophobic surface, an external electrical field and limited contact time during development. Such a thin continuous layer of hydrophobic toner powder which is spread on the surface of water can produce a satisfactory toner image on the member carrying an electrostatic latent charge pattern. However, it is difficult to consistently produce a thin uniform, continuous toner layer on the water. Therefore, such a system is highly unreliable.

Prior art development in transfer electrophotography has been carried on mainly by means of dry toners. The use of dry toners requires fusing the dry toner image which requires a considerable amount of heat. Further, when water was used it would discharge the charge on the charge bearing element because it is conductive.

SUMMARY OF THE INVENTION

The present invention is directed to a method and apparatus for developing electrostatic images by utilizing water to transport the toner to an electrostatic pattern or image. Advantageously in the present invention, the hydrophobic properties of the surface are discontinuous, an external electric field is not required and the development contact time is not limited. Further, little or no heat is required to fix the image.

An object of the present invention, is to simplify the developing, transfer and fixing steps involved in the production of an electrostatic, latent image or pattern on paper or other substrates.

Another object of the present invention is to eliminate the environmental hazards and waste products produced by prior art development methods. The invention eliminates these hazards and by-products by avoiding the volatile organic compounds and particulate material used in known systems. Instead, water is used to transport the toner to the electrostatic image or pattern. The water will develop only on the charged area without discharging the charge.

These and other objects are obtained by the present invention. In one embodiment of the invention, a system for developing an electrostatic latent image is provided. The system comprises a thin hydrophobic layer coated on a charge bearing member and a liquid toner made substantially of water or other hydrophilic liquid which contains soluble and/or particulate coloring matter. The liquid toner is held in a container in which a developer roller is partially submerged. Contact is made between the hydrophobic layer and the toner as the charge bearing member and developer roller are rotated. Such contact produces a visible image of a charge pattern on the charge bearing member. This image is transferred onto the paper or substrate. The hydrophobic layer is charged by any known method of charging, such as a corona. This charge can be either positive or negative.

In yet another embodiment of the invention, the image may be transferred by a transfer charge supplied by a transfer corona, by direct contact or by pressure contact.

In another embodiment, the charge bearing member is a photoconductive roller. Such a roller can be made of a metal substrate roller covered with a normal photo-conductive layer.

In still another embodiment, the charge bearing member is a dielectric roller capable of retaining latent image static charge with water development surface properties.

In another embodiment, the hydrophobic layer is an overcoat comprising hydrophobic particles of zinc stearate, or similar compound, dispersed in a resin binder. The hydrophobic particles may also be a metal soap, i.e., a metal reacted with a fatty acid.

In yet another embodiment of the present invention, a method for producing an electrostatic image is provided. The surface of the charge bearing element is coated with a layer of hydrophobic particles. These hydrophobic particles may be electrostatically or otherwise adhered to the roller surface and then locked to the surface using a solvent vapor. The particles can also be adhered by a flame spray or a mechanical dip process. The surface of the photoconductive roller is charged to create an image. The water toner moves through the layer of hydrophobic materials and adheres to the charged image on the photoconductive roller. This contact creates a visible image. The image is then transferred to a substrate, such as paper.

In still another embodiment, the toner is applied by a developer roller rotating through a water base toner containing suspended pigments. The photoconductive roller and the developer roller are rotated into contact with each other. This contact applies the toner to the surface and creates the electrostatic, latent image.

In yet another embodiment of the invention, the hydrophobic particles are preferably adhered to a thickness of about 20 microns.

In still another embodiment of the invention, the overcoat is a dispersion of fine particles of zinc stearate or other hydrophobic material in a resin binder. The overcoat is produced by dispersing the zinc stearate or other compound in a water-base latex of an acrylic resin, dipping the roller into the dispersion, draining the liquid, and air drying the roller. This overcoated roller retains the charge acceptance, light response and developing characteristics of the photoconductor roller.

DETAILED DESCRIPTION OF THE INVENTION

The present invention is directed to a method and apparatus for the development, transfer and fixing of an electrostatic image or pattern on a substrate, such as paper.

Figure 1:
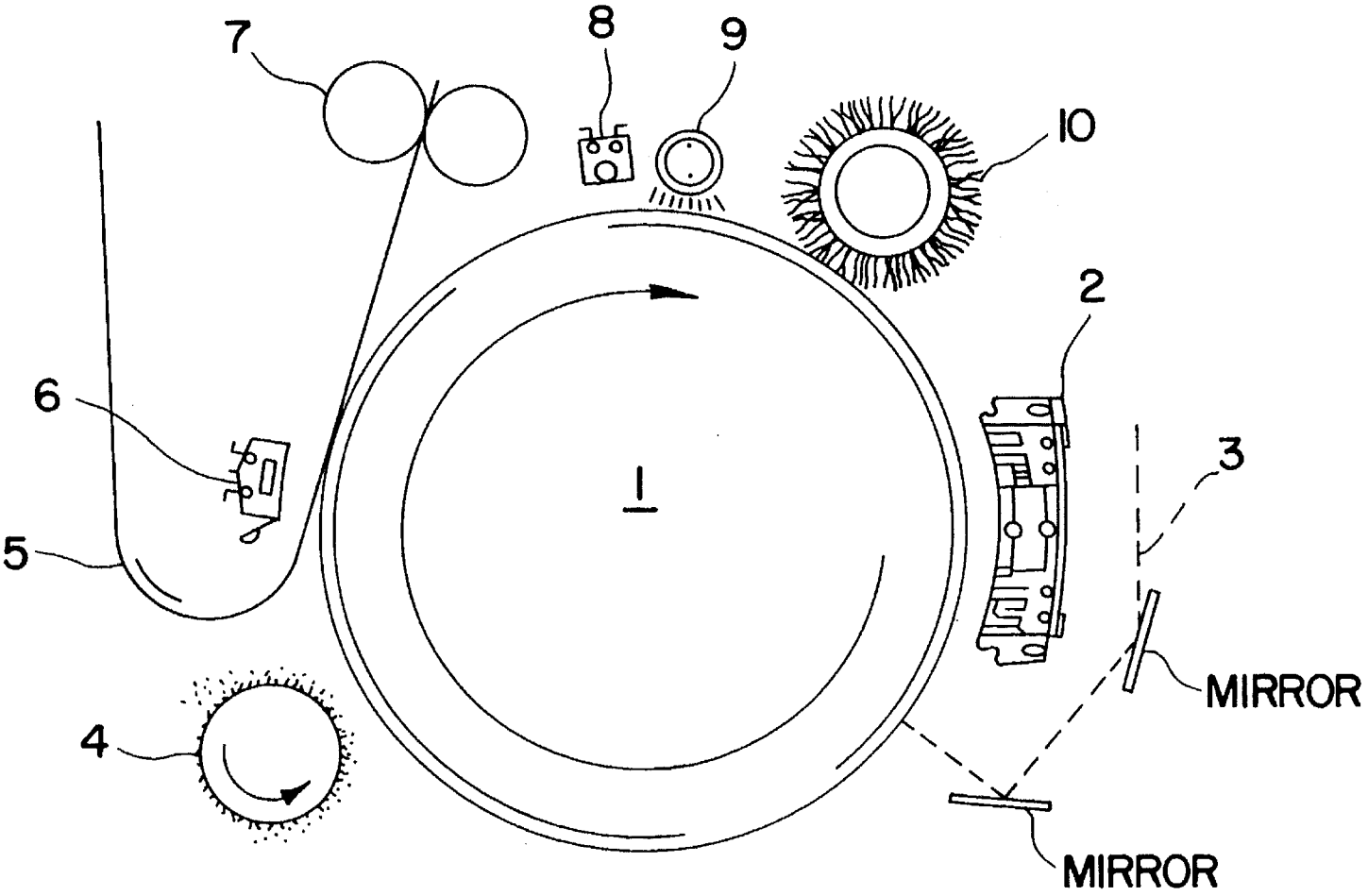
FIG. 1 PRIOR ART
FIG. 1 illustrates a typical system for electrophotography.

FIG. 1 shows a typical system for electrophotography. Such a system comprises a photo-conductor drum or roller 1. This drum 1 rotates past a charge or primary corona 2. The charge corona 2 creates a charge on the surface of the drum, e.g., −500 V. The charged drum surface is then exposed to light from a light imaging photoreceptor system 3. The surface of the drum 1 is exposed only where an image is desired. The drum 1 is then rotated to the development stage wherein the toner is applied to the exposed portions of the surface. The toner may be applied using a magnetic brush development system 4. This creates the latent electrostatic image. Next, the image is transferred to a substrate, such as paper, which is fed along the path 5. A transfer corona 6 is used to apply a transfer charge to the paper. The latent image is then fused to the substrate by the fuser 7. A clean corona 8, a clean lamp 9, and a cleaning brush 10, prepare the surface of the drum 1 for processing the next image.

Figure 2:
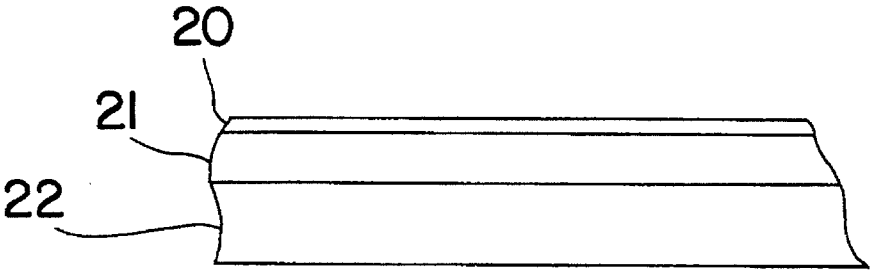
FIG. 2 illustrates the surface of the charge bearing element according to the present invention.

FIG. 2 illustrates the surface of the charge bearing element according to the present invention. An overcoat layer 20 is adhered to the charge bearing element 22. Between the drum 22 and layer 20 is a normal photoconductive layer 21 for a photoconductive roller. The overcoat consists of a thin layer of hydrophobic particles. The thin layer maybe between 1 and 5 mils and is preferably 20 microns thick. The charge bearing element 22 may also be a dielectric roller which retains latent electrostatic charge. The hydrophobic particles can also be used to coat the developer roller or both the photoconductive roller and the developer roller. The photoconductive roller also has water development surface properties.

The hydrophobic particles are adhered preferably electrostatically, to the surface of the roller with solvent vapor. The overcoat is preferably a dispersion of fine particles of zinc stearate or other hydrophobic material in a resin binder. Such an overcoat can be produced by dispersing zinc stearate in a water-base latex of an acrylic resin, dipping a photoconductor roller (such as made by Canon™ or IBM™) into the dispersion, draining the liquid and allowing the roller to dry. The overcoat may also be a metal soap, such as zinc stearate, i.e., a metal reacted with a fatty acid. Another method of producing the overcoat is by flame spray. A flame spray is basically a blow torch with forced air into which the hydrophobic material is injected. The hydrophobic powder is melted by the spray and reverts to solid on the cold surface of the charge bearing element. The coated roller retains the charge acceptance, light response and developing characteristics of a photoconductor with charge image quality. In other words, there is no distortion of the charge image itself. In some situations, the hydrophobic coating may also act as a dielectric, therefore, the element on which it is coated need only be a substrate.

Figure 3:
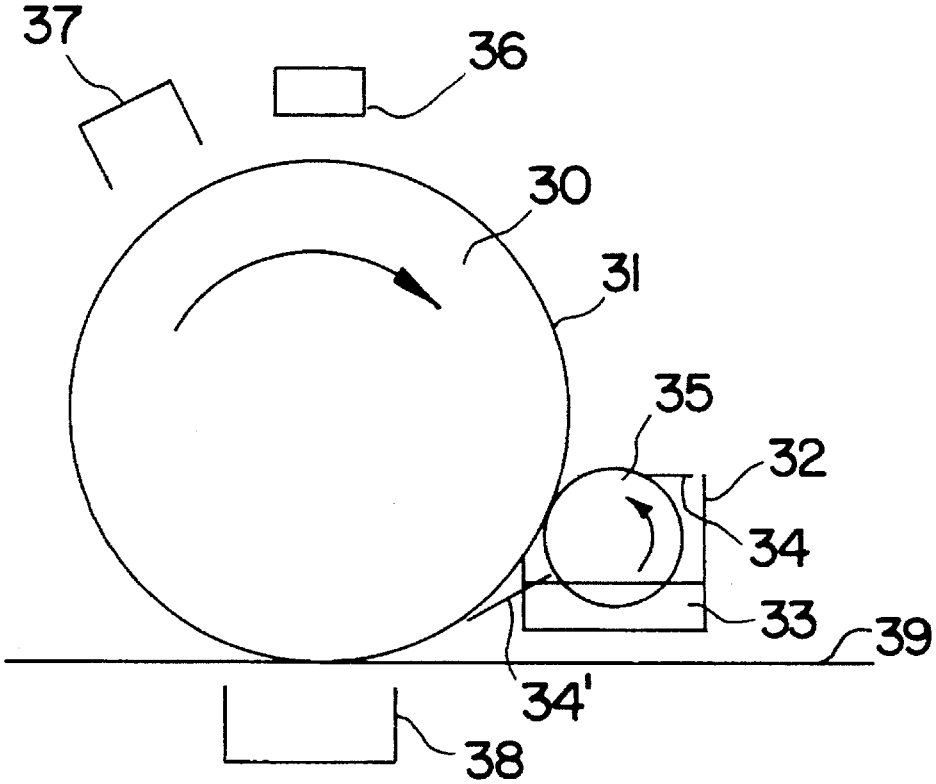
FIG. 3 illustrates an electro-photography system according to the present invention.

Referring to FIG. 3, a system according to the present invention is shown. The charge bearing element 30 has an overcoat 31 of hydrophobic particles. The surface of the roller is subject to a charge which creates an electrostatic image. If the charge bearing element is a dielectric roller, it can be charged by any electronic means, as known in the prior art. If the charge bearing element is a photoconductive roller, the charging is by any of the ways known in the art including by a primary corona 37. A toner tank 32 contains liquid toner 33 which is made substantially of water or other hydrophilic liquid containing soluble and/or particulate coloring matter. In other words, the toner is ink-like having pigment binder suspended in water. The application of the toner can be carried out by any method of bringing the ink in contact with the electrostatic image on the roller 30. Doctor blading 34', the use of a roller 35, and use of an impression development member may all be employed for this purpose. A developing roller or toner applicator 35 is partially submerged in the toner in the tank 32. In another embodiment, a sponge can be used to hold the toner. The sponge would prevent spills and leaks.

A primary corona 37 can be used to place the charge on the hydrophobic surface 31. An exposure system 36 exposes the charged surface to light for a photoconductive roller or to a charge pattern for a dielectric roller, thereby creating a latent, electrostatic image. The exposure system 36 can be a laser beam in a laser printer, a light imaging system as in FIG. 1, an array of LEDs, or other systems for emitting light.

The photoconductor roller 30, or dielectric roller, having an exposed surface rotates so that the exposed surface contacts the water base toner carried on the developing roller 35. The water base toner moves through the layers of hydrophobic particles and adheres to the charged image. Thus, the water develops only in the charged area and does not discharge the charge. Such contact produces a visible image of a charge pattern on the charge bearing element 30. Discrete water toner droplets of pigment/binder particles, which are 1 to 10 microns in diameter, are produced on the surface of the toner applicator roller 35 as it rotates through the water toner container 32 and past doctor blades 34,34'. The visible image is transferred onto a substrate, such as paper, under a transfer charge emitted by the transfer corona 38. The substrate is fed along the path 39. Advantageously, this transfer can also be done by direct contact or pressure contact with a roller.

In developing the invention tests were conducted. First, an overcoat of hydrophobic particles was applied to a metal roller. This roller was tested with etched and anodized surfaces. The roller was also tested with an elastomeric coating which contains discrete particles of hydrophobic materials. In all these situations, when the hydrohobic particles were placed between the charge bearing surface and the water developer, the desired result was obtained: development without discharge. The examples that follow go to the individual tests.

EXAMPLE I

A sheet of Versatec™ paper, which is a dielectric paper by Xerox™, was overcoated with Witco "Lubrazinc W"198

(grade number for zinc stearate) by hand rubbing the powder, i.e., zinc stearate, on the coated surface of the paper. The paper was then imaged by laying a plastic lettering guide over the coated surface and passing the guide and paper under a negative corona so that a negative charge pattern corresponding to the lettering guide was produced on the dielectric paper. The paper was then separated from the lettering guide and drawn across the surface of a mixture of India Ink, such as Pelikan™, and water of equal parts by volume. The water and ink mixture acted as the toner. The image produced was sharp and clear with no background showing. It did show excess deposits of the water ink mixture on circular or square charged areas. In these areas, the toner deposit was confined to the charged areas. Although a meniscus extended above the dielectric paper, the meniscus could be removed with a doctor blade having no effect on the image.

EXAMPLE II

The experiment of Example I was repeated using a positive corona. Similar results were obtained.

EXAMPLE III

The experiment of Example I was repeated using Lithium Stearate instead of zinc stearate. Similar results were obtained.

EXAMPLE IV

The experiment of Example I was repeated replacing the Lubrazinc™ with a spray coat of Scotch Guard™ as the source of the hydrophobic layer. Similar results were obtained.

EXAMPLE V

The experiment of Example I was repeated using Zinc Stearate in a water base to coat the paper. Similar results were obtained.

EXAMPLE VI

The experiment of Example I was repeated using 5 mils of Kapton™, a polyamide by Dupont, instead of Versatec™ paper overcoated with hydrophobic material. Similar results were obtained.

Figure 4:
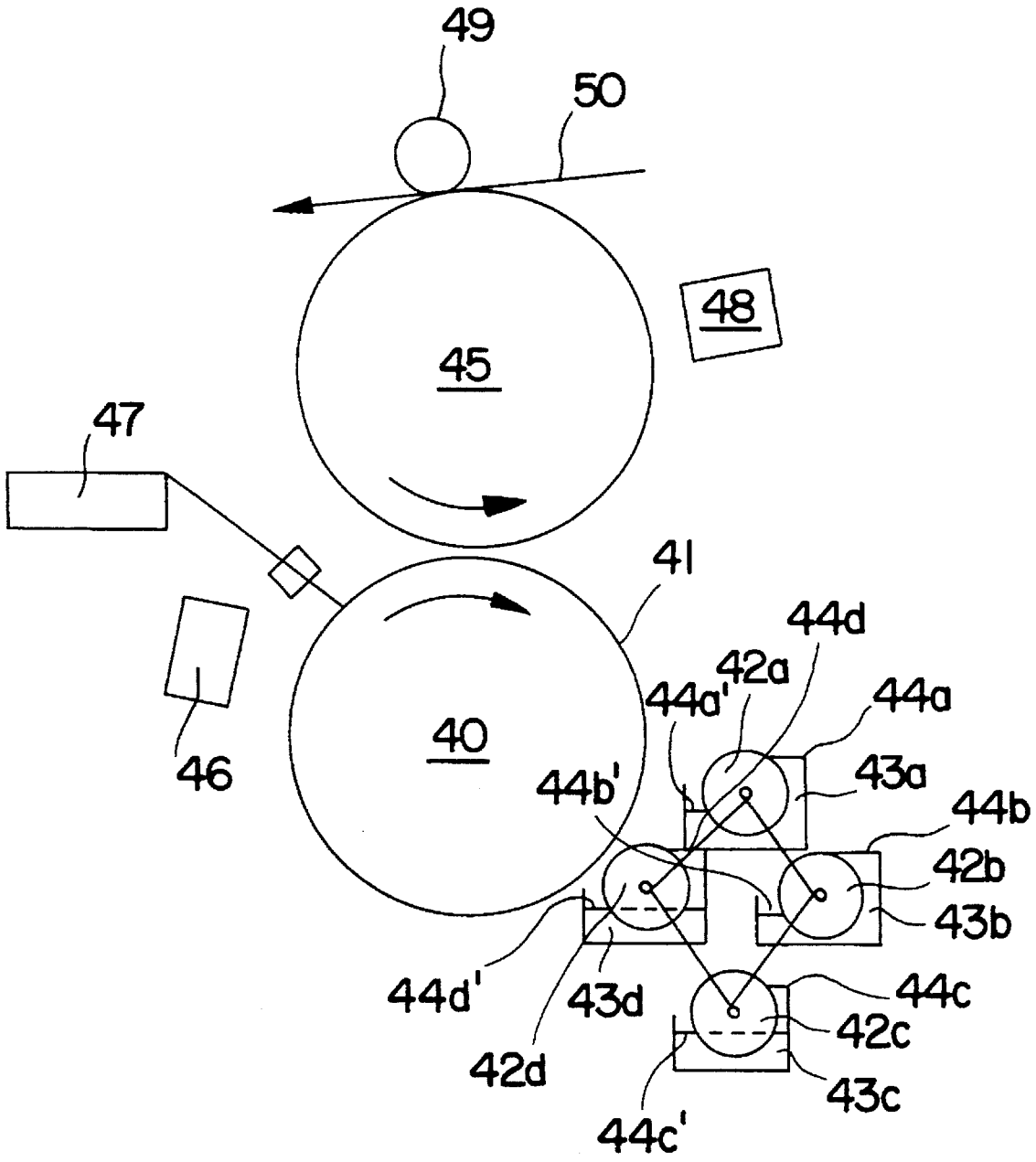
FIG. 4 illustrates a color electro-photography system according to the present invention.

The present invention is also applicable to Four-Color toner systems, as illustrated in FIG. 4. A photoconductor or dielectric roller 40 is overcoated with a layer 41 of hydrophobic particles as described above. Three or four color developer rollers 42*a–d* are rotationally positioned in containers 43*a–d* which hold the color water base toner. The four-color toners are preferably cian, magenta, yellow and black. Each color pigment with a resin binder is dispersed in a toner tank 43*a–d* having doctor blades 44*a–d*, 44*a'–d'* and developer rollers 42*a–d*. The four color toner is made with four developer tanks.

As above, the photoconductor roller 40 maybe charged by a corona 46 or other means such as a charge array for a dielectric roller and exposed by a light imaging system 47 or other means such as charge array or other known means for a dielectric roller before the toner is applied to create an electrostatic image for each color during each rotation of the roller 40. Charging a dielectric results in a pattern, the same as when a photoconductor is charged and exposed.

Each color toner is applied to the photo-conductor or dielectric drum 40 on their, i.e., the particular color's, latent charge image. Each color toner image on the photoconductor roller 40 is transferred through drum rotation to the transfer blanket drum 45 which accumulates the four color toner after four rotations.

A transfer corona 48 is used to apply a transfer charge to the paper or substrate 50. A third drum 49 is used as a support with transfer charge capability. The third drum 49 helps the paper accept the four color toner image from the blanket roller 45. By the time the paper 50 has separated from the transfer blanket drum 45 and the third drum 49, a full color image has been completely fused to the paper.

Finally, the above-described embodiments of the present invention are intended to be illustrative only. Numerous alternative embodiments may be devised by those skilled in the art without departing from the spirit and scope of the following claims.

We claim:

1. A water toning system for an electrophotography system, comprising a thin layer of hydrophobic particles on a charge bearing member, and a liquid toner made substantially of hydrophilic liquid with suspended pigment binders which liquid toner is brought into contact with the surface of said charge bearing member after it has been charged and exposed, wherein said thin layer of hydrophobic particles comprises zinc stearate particles dispersed in a resin.

2. A system for developing an electrostatic image comprising a charge bearing member having at least one surface, a thin hydrophobic layer on said at least one surface, liquid toner made substantially of hydrophilic liquid with suspended pigment binders, a container for holding said liquid toner, a toner applicator in contact with said liquid toner and said charge bearing member, means for charging said charge bearing member, means for exposing said surface of said charge bearing member, and means for transferring an image from said charge bearing member to a substrate, wherein said hydrophobic layer comprises zinc stearate particles dispersed in a resin binder.

3. The system of claim 2, wherein said container is a toner tank.

4. The system of claim 3, wherein said toner tank further comprises a sponge for holding the toner.

5. The system of claim 2, wherein said charge bearing member is one of a photo-conductor roller and a dielectric roller capable of retaining latent image static charge.

6. The system of claim 5, wherein said toner applicator comprises a developer roller and doctor blades.

7. The system of claim 6, wherein said image is obtained by contact of said developer roller with the liquid toner to said charge bearing member.

8. The system of claim 2, wherein said means for charging is a corona.

9. The system of claim 2, wherein said means for transferring is one of a corona, direct contact or contact pressure with a roller.

10. The system of claim 1, wherein said hydrophobic layer is about 20 microns thick.

11. The system of claim 2, wherein said hydrophobic layer is about 20 microns thick.

12. A method for producing an electrostatic image on a charge bearing member and developing said image, comprising charging a surface of said charge bearing member coated with a thin layer of hydrophobic particles, exposing said charged surface of the charge bearing member to create an electrostatic latent image, applying a liquid toner made substantially of hydrophilic liquid with suspended pigment binders to said electrostatic latent image, wherein said toner passes through said hydrophobic layer and adheres to said image without discharging said charge, and transferring said image to a substrate, wherein said thin layer of hydrophobic particles comprises zinc stearate particles dispersed in a resin binder.

13. The method of claim 12, wherein said applying a liquid toner, comprises, rotating a developer roller through said liquid toner, and contacting said developer roller to said charge bearing member thereby applying said toner.

14. The method of claim 12, wherein said charge bearing element is one of a photo-conductor roller and a dielectric roller capable of retaining latent image static charge.

15. The method of claim 12, wherein said hydrophobic layer is about 20 microns thick.

16. The method of claim 12, wherein said transferring of said image is by one of direct contact or contact pressure by a roller.

17. A system for developing an electrostatic image, comprising, a rotatable charge bearing element having at least one surface, a thin layer of hydrophobic particles on said at least one surface, means for charging said charge bearing element, means for exposing said charge bearing element, a plurality of containers, each container holding a different color liquid toner made substantially of hydrophilic liquid with suspended pigment binders of different colors, a plurality of toner applicators corresponding to said plurality of containers, wherein said containers and said applicators are rotationally positioned so that as said charge bearing member rotates each applicator individually contacts charge bearing element during one rotation, thereby creating a color toner image for each different color toner, a transfer blanket drum wherein each color toner image on said charge bearing element is individually transferred to said transfer blanket drum during one rotation, and a means for transferring said image on said transfer blanket drum to a substrate, wherein said thin layer of hydrophobic particles comprises zinc stearate particles dispersed in a resin binder.

18. The system of claim 17, wherein said transfer blanket drum is coated with a dielectric material and a hydrophobic material in a resin binder.

19. The system of claim 18, wherein said means for transferring is one of direct contact or contact pressure.

* * * * *